US006536758B2

(12) United States Patent
Meier et al.

(10) Patent No.: US 6,536,758 B2
(45) Date of Patent: Mar. 25, 2003

(54) CARD HOPPER

(75) Inventors: James R. Meier, St. Paul, MN (US); Steven J. Brandt, Savage, MN (US); Brent D. Lien, Minneapolis, MN (US); Spencer L. Tapp, Richfield, MN (US); Martin A. Pribula, Eden Prairie, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/967,501

(22) Filed: Sep. 28, 2001

(65) Prior Publication Data

US 2002/0105135 A1 Aug. 8, 2002

Related U.S. Application Data

(63) Continuation-in-part of application No. 09/604,214, filed on Jun. 27, 2000, which is a continuation-in-part of application No. 09/310,770, filed on May 10, 1999, now Pat. No. 6,315,283.

(51) Int. Cl.[7] ..... B65H 3/34

(52) U.S. Cl. ..... 271/104; 271/124; 271/138; 271/167

(58) Field of Search ..... 271/124, 121, 271/138, 167, 104

(56) References Cited

U.S. PATENT DOCUMENTS

| | | | | | |
|---|---|---|---|---|---|
| 2,867,437 | A | | 1/1959 | Davy | 271/44 |
| 2,937,019 | A | | 5/1960 | Rose | 271/44 |
| 3,290,042 | A | | 12/1966 | Johnson et al. | 271/44 |
| 4,443,006 | A | * | 4/1984 | Hasegawa | 271/124 X |
| 5,082,268 | A | | 1/1992 | Santoro | 271/14 |
| 5,299,796 | A | | 4/1994 | Wooldridge | 271/9 |
| 5,350,168 | A | * | 9/1994 | Sheridan | 271/121 X |
| 5,906,366 | A | * | 5/1999 | Chang | 271/124 |
| 6,029,972 | A | * | 2/2000 | Chang | 271/124 |
| 6,193,230 | B1 | | 2/2001 | Tung-Ying | 271/124 |
| 6,315,283 | B1 | * | 11/2001 | Haas et al. | 271/124 |

* cited by examiner

*Primary Examiner*—David H. Bollinger
(74) *Attorney, Agent, or Firm*—Westman, Champlin & Kelly

(57) ABSTRACT

A card hopper includes a control gate that reliably allows cards of varying thicknesses to be fed individually through an outlet opening without adjustment. The hopper is configured to hold a stack of plastic cards or similar, fairly rigid, substrates. The control gate is positioned at the outlet opening and includes a flexible blade that reduces a height of the outlet opening to less than a thickness of an end card of the stack, whereby the flexible blade flexes in response to the end card when driven through the outlet opening. Also disclosed is a card feeder assembly that includes the above-described hopper.

18 Claims, 5 Drawing Sheets

CARD HOPPER

CROSS REFERENCE TO RELATED APPLICATION

This is a continuation-in-part of U.S. patent application Ser. No. 09/604,214 filed Jun. 27, 2000 for a "CARD THICKNESS SELECTION GATE FOR A CARD FEEDER," which is a continuation-in-part of U.S. patent application Ser. No. 09/310,770, filed May 10, 1999 now U.S. Pat. No. 6,315,283 for an "INPUT HOPPER AND ENCODING STATION FOR CARD PRINTER," each of which is incorporated herein by reference.

BACKGROUND OF THE INVENTION

The present invention relates to a control gate for an outlet of a card or substrate storage hopper used with a card printer or other card processing instrument, which can handle a wide range of card thicknesses.

Printers for ID cards and like substrates that will accept different cards or substrates have been advanced. These card printers require card feeders that can reliably handle the different sized cards and feed them to the printer. Most card feeders include a hopper for holding a supply of cards and a rigid gate having an edge that defines an outlet opening through which the cards are ideally fed individually. Problems can arise when the outlet opening is not matched to the thickness of the card being feed. For example, if the outlet opening is too large, double feeds of thin cards can occur. Similarly, if the outlet opening is too small, misfeeds of thick cards can occur.

One solution to the problem is to provide a card feeder that has a control gate that allows an operator to control the height of the outlet opening in accordance with the type of card being fed. Although, the adjustable gate provides the ability to feed different card types (i.e., cards having different thicknesses), it typically must be adjusted each time the card type is changed. Additionally, this type of gate can encounter feeding problems caused by warped cards that are bowed up or down resulting in a change in the effective thickness of the card relative to a flat card.

It would be desirable to have a control gate of a card hopper that is adapted to handle a range of card thicknesses including warped cards without requiring adjustment to the position of the control gate.

SUMMARY OF THE INVENTION

The present invention relates to a card hopper that includes a control gate that allows cards of varying thicknesses to be fed individually through an output opening of the hopper without adjustment. The hopper is configured to hold a stack of plastic cards or similar, fairly rigid, substrates. The control gate is positioned at the outlet opening and includes a flexible blade that reduces a height of the outlet opening to less than a thickness of an end card, whereby the flexible blade flexes in response to the end card when driven through the outlet opening.

The present invention is also directed to a card feeder that includes the above-described hopper as well as a card drive for urging an end card of the stack through the outlet opening.

DETAILED DESCRIPTION OF THE ILLUSTRATIVE EMBODIMENTS

Figure 1:
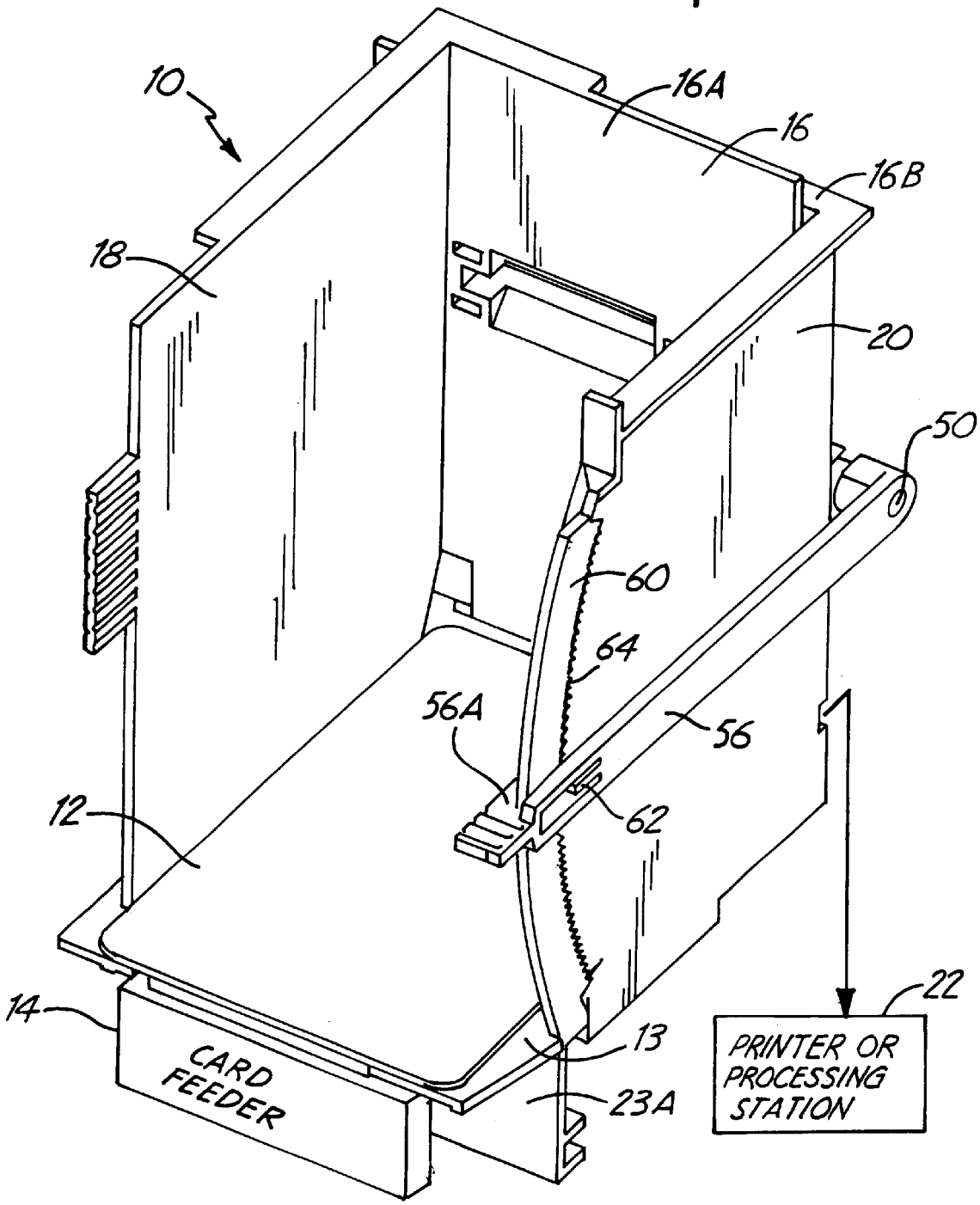
FIG. 1 is a perspective view of a card hopper viewed from an open end in accordance with an embodiment of the invention.
Figure 2:
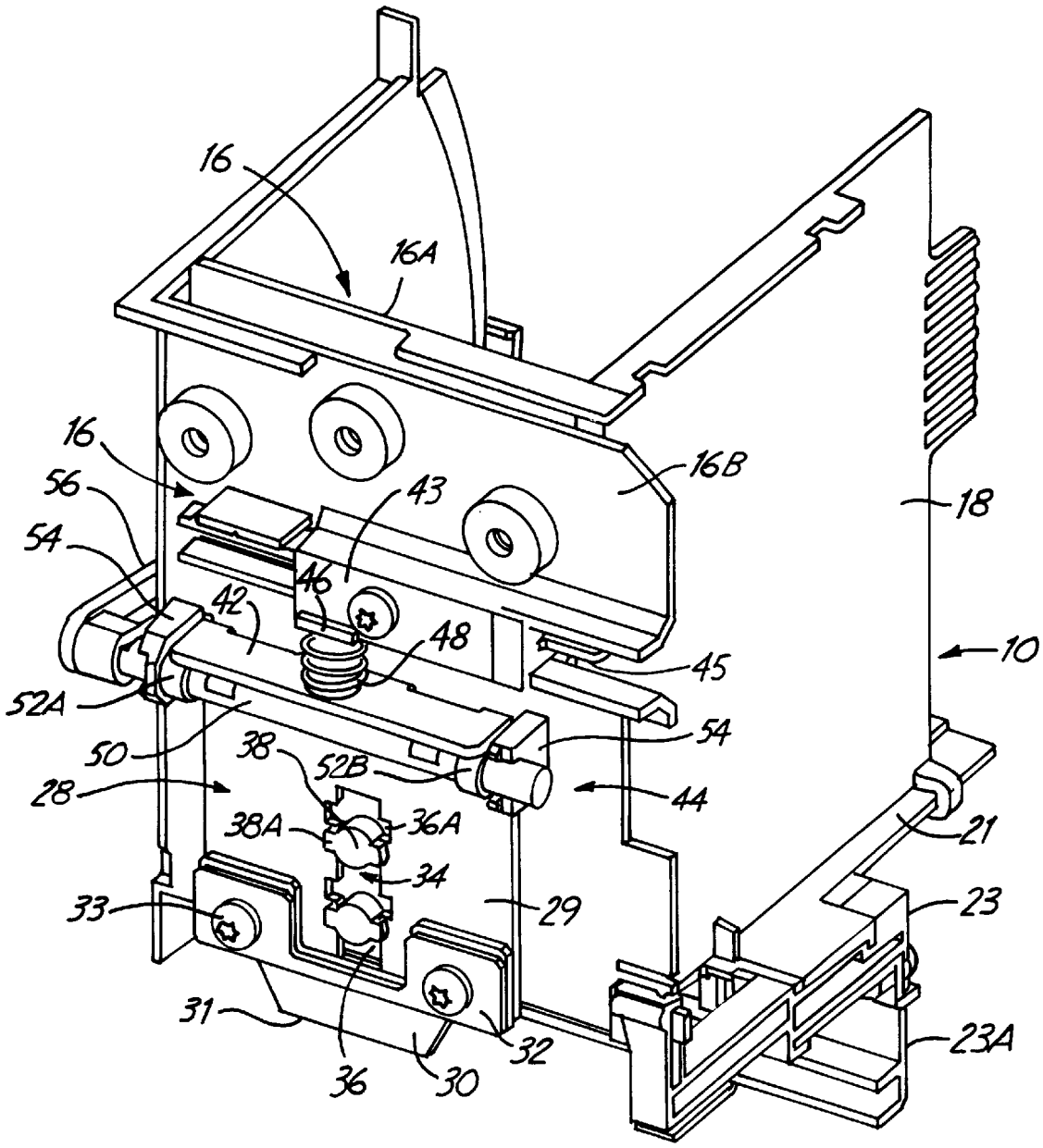
FIG. 2 is a perspective view of the outlet end of the card hopper of FIG. 1, in accordance with various embodiments of the invention.

Referring to FIG. 1, a card hopper, generally designated as 10, is configured to support a stack of cards. An end card 12 is shown at a bottom end 13 of the hopper 10 in position for a card feeder 14 to drive card 12 toward an outlet wall 16 leading to a printer or processing station 22. The card feeder 14 comprises conventional drive rollers, such as drive roller 14A, shown in FIG. 3. The hopper 10 includes laterally adjustable sidewalls 18 and 20. The front wall or outlet end wall 16 is made up of wall sections 16A and 16B. The wall section 16A is attached to side wall 18 and wall section 16B is attached to side wall 20. The hopper 10 has an open rear as shown in FIG. 1, for stacking cards in place. The side walls 18 and 20 can be adjusted laterally in a desired fashion to accept cards of different widths. The slidable wall sections can be mounted in any desired way. As shown in FIG. 2, the side wall 18 and front wall section 16A are mounted on a slider 21 that moves on a track 23 that mounts on a frame. The wall 20 is fixed to track 23 which mounts on a frame 23A, which is fixed to the frame of the printer or processing station 22.

Figure 3:
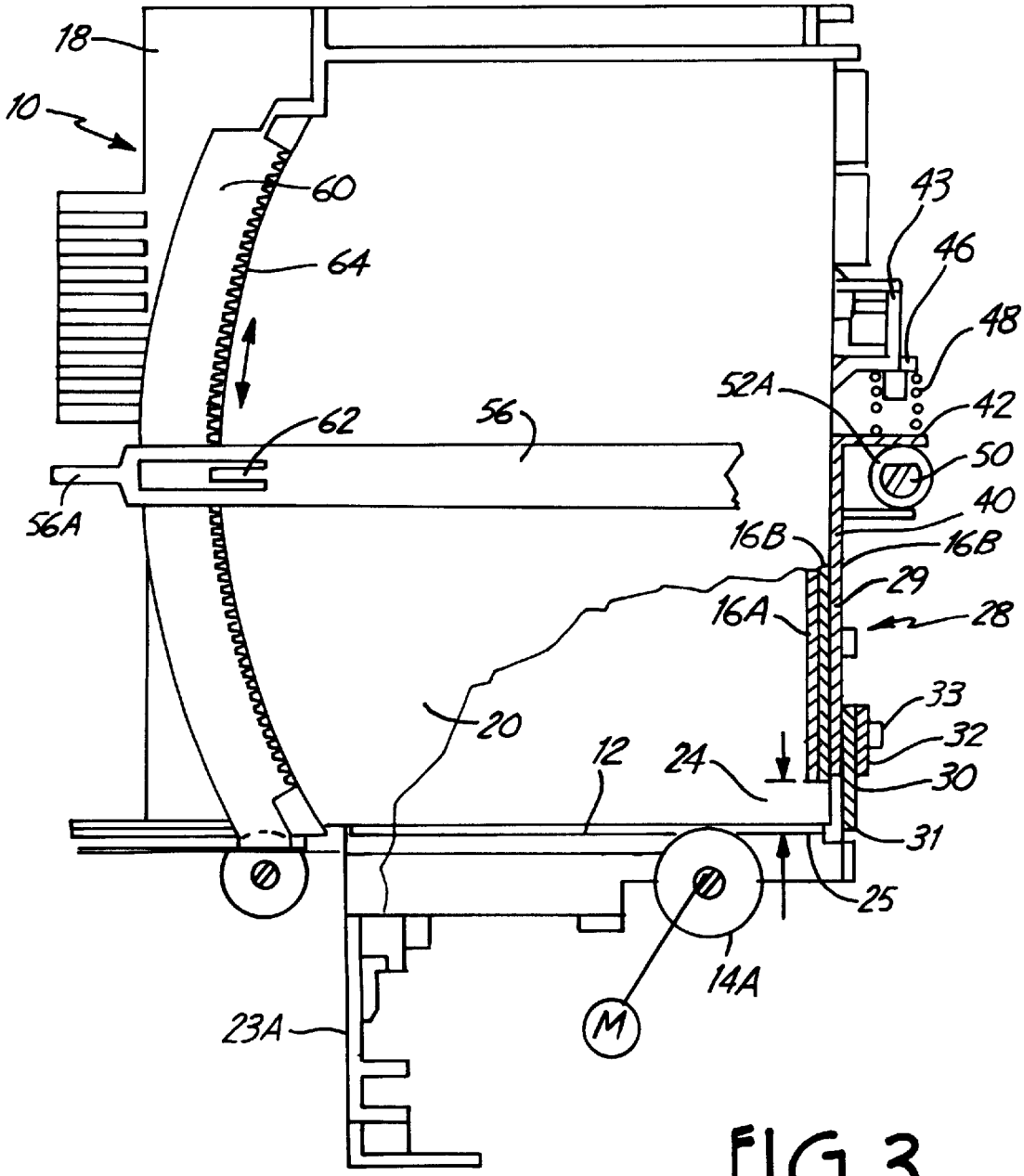
FIG. 3 is a side view of the card hopper of FIGS. 1 and 2 with parts in section and broken away to show the cam operator.

The cards 12 are fed through an outlet opening 24 to the printer 22. The printer 22 would be any desired card printer that would receive the cards and print on them, or it could be a further card processing station, such as a lamination station. The outlet opening from the hopper is defined by a card support plane of the card feeder, or if the hopper has a bottom tray, by the bottom tray. A card 12 is shown in position in FIGS. 3 and 4 adjacent to the opening 24. The card support plane is defined by the bottom surface of that card and bottom edge 25. The maximum height of the hopper outlet opening 24 is defined by the lower edges of front wall sections 16A and 16B as shown in FIG. 3. As discussed in greater detail below, a control gate or gate assembly 28 controls the actual height of the outlet opening.

It is desirable at times to have cards of different thickness fed to the same printer or processing station. When this is done, the fixed, maximum height of outlet opening 24, which is shown in FIG. 3 by the double arrow 26, must accommodate such varying card thicknesses such that they can be fed individually through the outlet opening 24 while avoiding misfeeds and double feeds of cards. Gate assembly 28 of the present invention allows for a coarse adjustment of the height of opening 24 as desired while automatically accommodating a wide range of card thicknesses in response to cards being driven therethrough.

Figure 4:
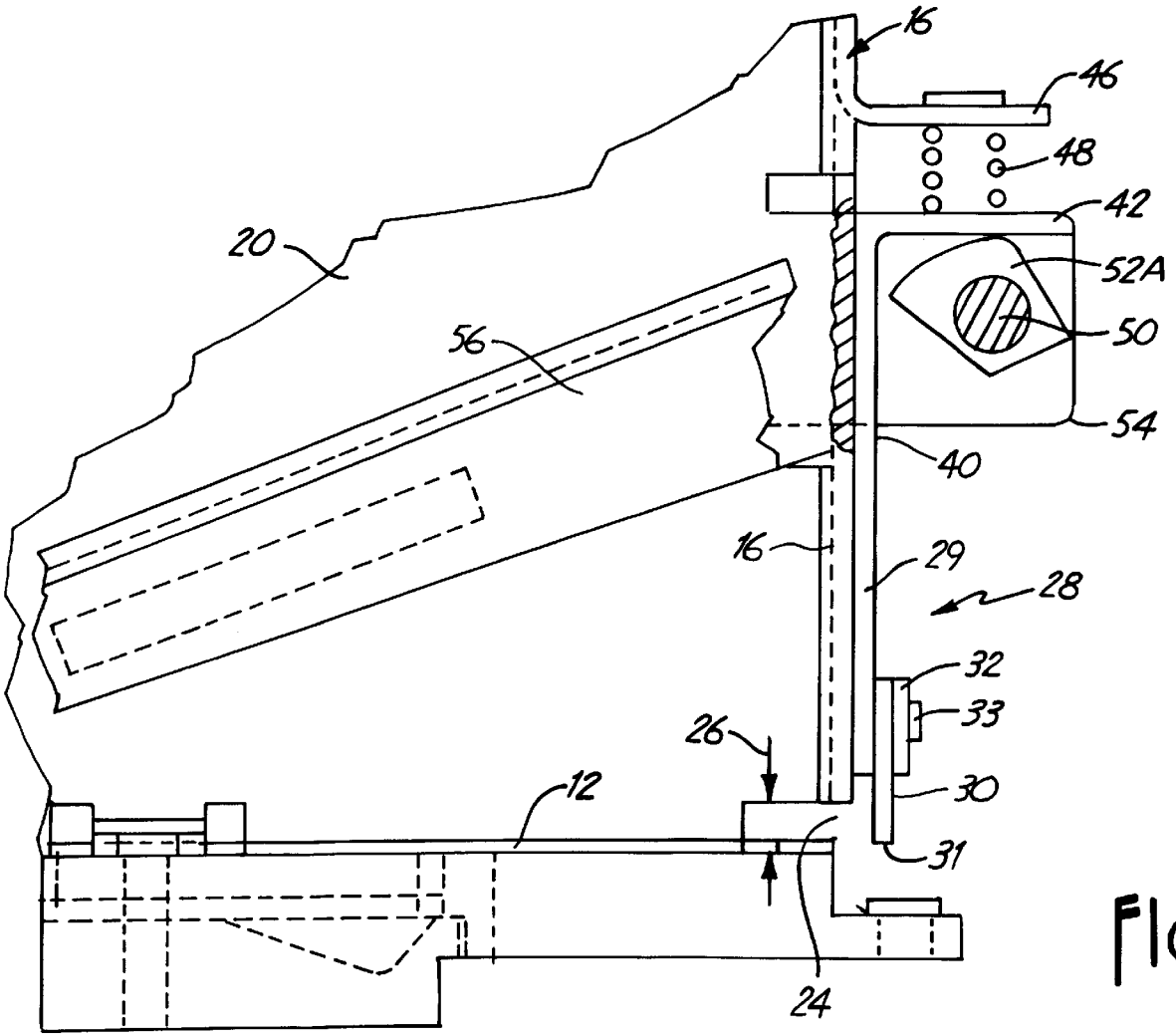
FIG. 4 is an enlarged side sectional view of the cam operator used in the card hopper of FIGS. 1–3.

Gate assembly 28 generally includes a slide plate 29 and a flexible blade 30 having a bottom edge 31, as shown in FIGS. 2, 3 and 4. Flexible blade 30 can be mounted to slide plate 29 in accordance with conventional methods. In one embodiment, flexible blade 30 is sandwiched between plate 32 and slide plate 29 and secured by screws 33.

Alternatively, flexible blade 30 could be formed integral with slide plate 29.

The vertical position of gate assembly 28 can be adjusted along the front wall 16 such that the bottom edge or surface 31 will change in vertical height relative to the support plane of the bottom card 12 in the hopper 10 so that the effective vertical height of the outlet opening 24 can be adjusted. The slide plate 29 has a center inset region 34 with a slot 36 defined therein. Suitable guides 38 are fixed to the wall section 16B, and the guides slide in the slot and hold the gate in proper position against front wall section 16B. The guides have wings 38A that fit over the sides of the slot. The slot has notches 36A which will permit removal of the slide from the guides when the notches are aligned with the wings 38A.

Slide plate 29 mounts to an actuator flange 42 that overlies end portions of a cam shaft assembly 44. The flange 42 extends outwardly from the wall 16, as can be seen in FIGS. 2 and 3. The flange 42 of the actuator plate 40 is aligned with a lug or flange 46 that extends out from a block 43 integrally supported on front wall section 16A. A guide 45 is mounted on the front wall section 16A and the block 43 slides on the guide 45 to permit the wall section 16B to move laterally relative to wall section 16A when the width of the card hopper 10 is adjusted.

A spring 48 is positioned between the flange 46 and the actuator flange 42, as can be seen in FIGS. 2 and 3 to provide a spring load that loads the flange 42 against the cam shaft assembly 44 and urges the plate 40 toward a closed position. The cam shaft assembly 44 has a shaft 50, and a pair of cams 52A and 52B that underlie the flange 42. One cam 52A is shown in FIG. 4 so that the shape of the cam can be seen. The cam shaft assembly 44 is rotatably mounted in a pair of ears 54 that extend outwardly from and are supported on the front wall section 16B.

The cam shaft 50 extends laterally outwardly from the cam 52A, and has an actuator, shown as a manual actuating lever 56, drivably mounted thereon. The lever 56 extends along the side of the wall 20 (see FIG. 1), toward an arcuate guide 60 which slidably fits into a slot in an end portion 56A of the lever 56. The end portion 52A has a spring latch 62. The latch 62 is made to spring load against and fit into one of the series of notches 64 that are defined in an edge of the guide 60. By manually pivoting the lever 58 up and down, the latch 62 will ratchet along the notches 64 as the end of lever 56 is adjusted vertically. The movement of the lever 56 will cause the cam shaft 50 to rotate. This will rotate the cams 52A and 52B, to act on the flange 42 and change the position of the gate assembly 28, and specifically the bottom edge 31 of the flexible blade 30, relative to the lower edge of card outlet opening 24.

The series of notches or detents 64 can be made so that the gate assembly can be stopped in positions corresponding to those needed for standard card thicknesses for the card 12 in the hopper or ranges of card thicknesses. Additionally, a locking mechanism (not shown) can be mounted to lever 56, preferably at end 56A, to lock the position of latch 62 and prevent accidental adjustment to lever 56.

In accordance with a preferred embodiment of the invention, the vertical position of slide plate 29 of gate 28 is adjusted such that flexible blade 30 is positioned to engage the front edge of bottom card 12 as it is driven out opening 24. When in this position, flexible blade 30 will flex in response to the thickness of the card being driven through opening 24 to automatically adjust the height of the opening 24 accommodate the card while preventing multiple card feeds. This aspect of the present invention is advantageous over gates of the prior art since, for a given vertical position of slide plate 29, opening 24 will be automatically adjust in response to the thickness of the cards driven therethrough such that a range of card thicknesses are accommodated. This eliminates the necessity to adjust the gate position each time the card thickness changes, as is the case with gates of the prior art. This flexibility to accommodate a range of card thicknesses also allows gate 28 to handle warped cards without adjustment.

Figure 5A:
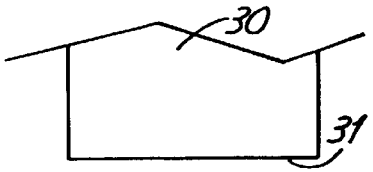
FIGS. 5*a–f* are partial front views of a flexible blade in accordance with various embodiments of the invention.
Figure 5B:
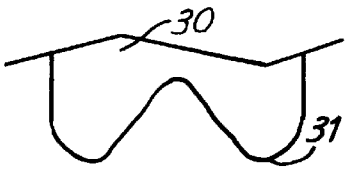
Figure 5C:
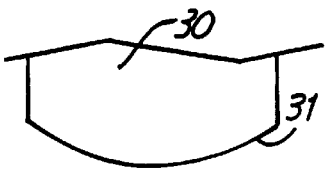
Figure 5D:
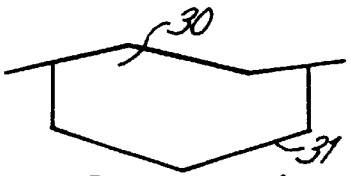
Figure 5E:
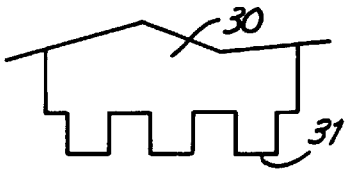
Figure 5F:
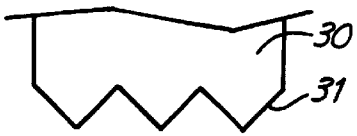
Figure 6A:
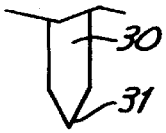
FIGS. 6*a–c* are side views of a flexible blade in accordance with various embodiments of the invention.
Figure 6B:
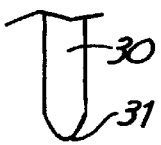
Figure 6C:
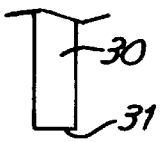

The distance flexible blade 30 extends below slide plate 29, the material used to form it, its thickness, its cross-sectional shape, and the shape of the bottom edge 31 can be adjusted as desired to provide optimum performance. Flexible blade 30 is preferably formed of rubber, such as 9050 silicone rubber, plastic, rubber coated plastic, reinforced rubber, or other flexible and durable material. In accordance with the depicted embodiment, flexible blade 30 is approximately 0.16 inches in thickness, approximately 0.75 inches in width, and extends approximately 0.125 inches below slide plate 29. FIGS. 5*a–f* show examples of other shapes bottom edge 31 of flexible blade 30 can have, such as rectangular (FIG. 5*a*), curved (FIGS. 5*b–c*), pointed (FIG. 5*d*), square-toothed (FIG. 5*e*), and saw-toothed (FIG. 5*f*). Additionally, the cross-sectional shape of flexible blade portion can take on various forms such as pointed, rounded, or square, as respectively shown in FIGS. 6*a–c*. Flexible blade 30 can take on other shapes as well.

Card feeder mechanism 14 generally includes driver rollers 14A driven by a suitable motor, as shown in FIG. 3, to drive the bottom card 12 through the opening 24 causing flexible blade 30 to bend outward in the direction card 12 is traveling. Drive roller 14A is preferably coated with rubber or other material to increase the frictional resistance between drive roller 14A and the bottom surface of bottom card 12. To further increase this frictional resistance, a downward force, represented by arrow 63 in FIG. 3, is preferably applied to the stack of cards in hopper 10 using a weight, a spring-loaded mechanism or other conventional means. The high frictional resistance between drive roller 14A and bottom card 12 provides the card feeder 14 with enough gripping power to force the card 12 through the opening 24 and under flexible blade 30. The frictional resistance between the top of card 12 and the card immediately above is small in comparison to that between the card 12 and the drive roller 14A. As the bottom card 12 is fed forward, the forward motion of the card immediately above the bottom card 12 is restricted by the flexible blade 29 which causes it to slide on the top surface of the bottom card 12 and replace the bottom card 12 once bottom card 12 is completely fed through opening 24.

Although the present invention has been described with reference to preferred embodiments, workers skilled in the art will recognize that changes may be made in form and detail without departing from the spirit and scope of the invention. For example, the hopper could be configured to raise the stack of cards and force the top card, rather than the bottom card, through a suitable outlet opening. Furthermore, the adjustment to the vertical position of the gate assembly could be made electronically in accordance with card thickness sensors, or by a direct manual input.

What is claimed is:

1. A card feeder assembly including:

a hopper for storing a stack of cards to be fed, each card having a thickness;

a card drive for urging an end card of the stack from the hopper, said card drive being driven to move cards in a first direction and forming a support plane for the end card in the stack;

a wall of said hopper having an outlet opening therethrough aligned with the end card and through which the end card is fed when driven by the card drive;

a control gate slidably mounted relative to the outlet opening and having a flexible blade that reduces a height of the outlet opening to less than a thickness of the end card, whereby the flexible blade flexes in response to the end card when driven through the outlet opening; and a cam operator for changing the position of the control gate to adjust the height of the outlet opening.

2. The card feeder assembly of claim 1, wherein said cam operator comprises a rotatable cam, a cam follower on the control gate, said cam follower engaging said cam and shifting as the cam is rotated to change the dimension of the outlet opening.

3. The card feeder assembly of claim 2, wherein said rotatable cam is mounted on a cam shaft, and the card feeder assembly including a lever drivably mounted on said cam shaft and movable manually to rotate the cam to a desired position.

4. The card feeder assembly of claim 1, wherein said cam operator includes a rotatable cam having a smoothly curved cam surface.

5. The card feeder assembly of claim 1, wherein said control gate comprises an actuator tab positioned at substantially right angles to the plane of movement of the control gate, the actuator tab forming a cam follower member that engages a rotatable cam of the cam operator for moving said cam follower member to control the position of the control gate.

6. The card feeder assembly of claim 5, wherein said cam comprises a rotary cam directly engaging the tab.

7. The card feeder assembly of claim 1, wherein said cam operator comprises a wedge shaped linearly movable cam, and said cam follower including a linearly moving member engaging the tab and sliding along the surface of said linearly movable cam.

8. The card feeder assembly of claim 1 including a stop member to hold a cam of the cam operator in a desired position.

9. The card feeder assembly of claim 8, wherein the cam is a linearly movable cam and said stop member comprises a screw tightenable down onto the linearly movable cam.

10. The card feeder assembly of claim 8, wherein the cam comprises a rotatable cam moved by a lever, and said stop member comprises a latch for stopping the movement of said lever.

11. The card feeder assembly of claim 1 including a manually operable member connected to a cam of the cam operator and having a finger tab at an outer end thereof accessible adjacent to the hopper.

12. The card feeder assembly of claim 1 including a spring for urging the control gate in a first direction.

13. The card feeder assembly of claim 1, wherein the flexible blade has a bottom edge having a curved, saw-toothed, square-toothed, flat, or pointed shape.

14. The card feeder assembly of claim 1, wherein the flexible blade is formed of rubber, plastic, rubber coated plastic, or reinforced rubber.

15. A card hopper for use with a card feeder mechanism to feed individual cards from an end of a stack of cards, the card hopper comprising:

a card housing having an opening for receiving a stack of cards;

an end wall of the card housing having an outlet opening therethrough aligned with an end card;

a control gate slidably mounted relative to the outlet opening and having a flexible blade that reduces a height of the outlet opening to less than a thickness of the end card, whereby the flexible blade flexes in response to the card when driven through the outlet openings; and a cam operator for changing the position of the control gate to adjust the height of the outlet opening.

16. A card feeder assembly including the card hopper of claim 15 and a card drive adapted to drive the end card through the outlet opening.

17. The card hopper of claim 15, wherein the flexible blade has a bottom edge shaped that is saw-toothed, square-toothed, pointed, flat or curved.

18. The card feeder assembly of claim 15, wherein the flexible blade is formed of rubber, plastic, rubber coated plastic, or reinforced rubber.

* * * * *